US007697879B2

(12) United States Patent
Watanabe et al.

(10) Patent No.: US 7,697,879 B2
(45) Date of Patent: Apr. 13, 2010

(54) ELECTROPHOTOGRAPHIC IMAGE FORMING APPARATUS AND PROCESS CARTRIDGE

(75) Inventors: Taku Watanabe, Susono (JP); Kohei Matsuda, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 133 days.

(21) Appl. No.: 12/019,902

(22) Filed: Jan. 25, 2008

(65) Prior Publication Data

US 2008/0181691 A1 Jul. 31, 2008

(30) Foreign Application Priority Data

Jan. 29, 2007 (JP) ..... 2007-017743

(51) Int. Cl.
*G03G 15/00* (2006.01)
*G03G 15/08* (2006.01)
*G03G 21/00* (2006.01)

(52) U.S. Cl. ..... 399/350; 399/159; 399/286

(58) Field of Classification Search ..... 399/111, 399/159, 252, 279, 286, 350
See application file for complete search history.

(56) References Cited

U.S. PATENT DOCUMENTS 5,987,277 A * 11/1999 Okabe ..... 399/103
2003/0108360 A1* 6/2003 Ogasawara ..... 399/159
2004/0120729 A1* 6/2004 Uyama et al. ..... 399/129
2007/0264049 A1* 11/2007 Kamoshida et al. ..... 399/350 X

FOREIGN PATENT DOCUMENTS

JP 6-230650 A 8/1994
JP 2005-221858 A 8/2005

OTHER PUBLICATIONS

Machine translation of JP 2005-221858 A dated Aug. 5, 2009.*

* cited by examiner

*Primary Examiner*—Sophia S Chen
(74) *Attorney, Agent, or Firm*—Fitzpatrick, Cella, Harper & Scinto

(57) ABSTRACT

An electrophotographic image forming apparatus forming an image on a recording medium, includes: an electrophotographic photosensitive member having a photoconductive layer on a rigid base; an exposure device forming a latent image on the electrophotographic photosensitive member; a developer carrying member that carries a developer to develop the latent image using the developer in contact with the electrophotographic photosensitive member; and a cleaning blade that cleans the electrophotographic photosensitive member in contact with the electrophotographic photosensitive member, wherein the following expression is satisfied: Le≧Ldr>Lcl, where Le: a longitudinal length of the photoconductive layer Le, Ldr: a longitudinal length of the developer carrying member to be contacted with the electrophotographic photosensitive member, and Lcl: a longitudinal length of the cleaning blade to be contacted with the electrophotographic photosensitive member.

4 Claims, 11 Drawing Sheets

Ldr>Lcl

Ldr>Lcl

Ldr>Lcl≧Lr

Ldr>Lcl≧Lt

ELECTROPHOTOGRAPHIC IMAGE FORMING APPARATUS AND PROCESS CARTRIDGE

BACKGROUND OF THE INVENTION

1. Field of the Invention

The present invention relates to an electrophotographic image forming apparatus and a process cartridge.

Here, an electrophotographic image forming apparatus is the one that forms an image on a recording medium (for example, a recording paper, an OHP sheet, a cloth and the like) employing an electrophotographic image forming method. Examples of the electrophotographic image forming apparatus include an electrophotographic copying machine, an electrophotographic printer (for example, a laser beam printer, an LED printer and the like), a facsimile machine and a compound machine thereof (multi-function printer).

In addition, a process cartridge is a cartridge into which the electrophotographic photosensitive member and at least one of a charging device, a developing device, and a cleaning device functioning as a process unit acting on this electrophotographic photosensitive member are integrally incorporated. Further, this cartridge is to be detachably mountable to an electrophotographic image forming apparatus main body.

2. Description of the Related Art

In an electrophotographic image forming apparatus, from the advantage of reproducibility of a half-tone image or suppression of an excessive edge effect of an image, a contact development method is widely employed. The contact development method means the system in which a developer carrying member included in a developing device is brought into contact with an electrophotographic photosensitive member, and a latent image having been formed on the electrophotographic photosensitive member is developed using a developer (toner).

The contact development method, in order for an electrophotographic photosensitive member and a developer carrying member to be evenly in close contact in the rotational axis direction of the electrophotographic photosensitive member and the developer carrying member, is generally arranged such that one member is an elastic member (inclusive of e.g., a sheet that is backed up by an elastic member) and the other is a rigid member. The simplest construction is such a construction that the electrophotographic photosensitive member is a rigid member and the developer carrying member is an elastic member. In particular, in the case where a process cartridge that is detachably mountable to an image forming apparatus main body is constructed to incorporate an electrophotographic photosensitive member and a developer carrying member, the above-mentioned combination is frequently employed in the process cartridge.

In a cylindrical developer carrying member (developing roller) to be attached to an opening portion of a developing frame the process cartridge includes, there are roughly two ways of developer seal methods at the end portion in the rotational axis direction (hereinafter, it is referred to as a longitudinal direction) of the developer carrying member.

One is a developing roller circumferential surface seal method. In this method, used is a developing roller longer than the longitudinal length of the above-mentioned opening. Further, in a developing frame, both end portions that are provided to be opposed to the circumferential surface of the developing roller are formed to be circular-arc shaped, and a seal member such as a felt material or a moltopren is bonded to each of these end portions. Moreover, this seal member is pressed to the circumferential surface of the developing roller to seal a developer.

The other one is a developing roller cross section seal method. In this method, used is a developing roller rather shorter than the longitudinal length of the above-mentioned opening. Further, in the developing frame, with both side walls that are provided to be opposed to the cross section (cross section orthogonal to the longitudinal direction) of the circumferential surface of the developing roller where a developer is carried, the shaft core that is provided inside of the circumferential surface portion of this developing roller is rotatably held. Moreover, there is located a seal member such as a felt material or a moltopren in a gap between both side walls and the developing roller circumferential surface portion to seal a developer (toner).

Although the above-mentioned two seal methods have merits or demerits of a seal performance of the developer, the developing roller circumferential surface seal method is excellent in terms of the ease of assembly. In the case of employing the developing roller circumferential surface seal method, there are produced on the circumferential surface of the developing roller the area where the developer is carried (developer coat area) and the area where no developer is carried (developer non coat area).

In addition, there is a possibility that a slight developer is stuck onto the electrophotographic photosensitive member to be contacted with the developing roller as a matter of course. Therefore, the longitudinal length of a cleaning blade (cleaning member) serving as a cleaning device to be contacted with the electrophotographic photosensitive member to remove the developer on the electrophotographic photosensitive member, not depending on the above-mentioned two seal methods, is usually set to be larger than the longitudinal length of the developing roller (for example, Japanese Patent Application Laid-Open No. H06-230650). Exceptionally, as disclosed in Japanese Patent Application Laid-Open No. H06-230650, there is an example in which the length of the developing roller is shorter than the length of the cleaning blade. Japanese Patent Application Laid-Open No. 2005-221858 is what solves an inherent problem that is generated at the time of using an electrophotographic photosensitive member having flexibility.

SUMMARY OF THE INVENTION

In an electrophotograhic image forming apparatus, of which an electrophotographic photosensitive member is rigid, and which is the type of the contact development method, the length of a developer carrying member < the length of a cleaning blade. In this instance, a photoconductive layer of the electrophotographic photosensitive member is largely abraded at the end portions in a contact area between the electrophotographic photosensitive member and the developer carrying member. When this photoconductive layer is abraded, the leakage from the developing roller is generated, resulting in the production of a defective image.

The present inventors have found that one cause of abrasion of the photoconductive layer of the electrophotographic photosensitive member depends on whether there is present or absent an interposed substance between the electrophotographic photosensitive member and the developer carrying member. As described above, on the developer carrying member, there are a developer coat area and a developer non coat area. Furthermore, in the developer non coat area where no developer is interposed between the electrophotographic photosensitive member and the developer carrying member, the developer carrying member frictionally slides on and grinds the electrophotographic photosensitive member directly, thus increasing abrasion of the photoconductive layer of the electrophotographic photosensitive member. In case not only the developer but also an interposed substance to buffer frictional sliding and grinding between the electrophotographic photosensitive member and the developer carrying member such as an abrasion dust of the photoconductive layer is resided, abrasion of the photoconductive layer is suppressed. It is found, however, that since the cleaning blade cleans substantially all interposed substances that are present on the electrophotographic photosensitive member, abrasion of the photoconductive layer is not suppressed. A dielectric strength is reduced at the abraded portion, so that for example, the leakage of a developing bias is induced to be the cause of the generation of a defective image.

According to the present invention, it is possible to provide an electrophotographic image forming apparatus and a process cartridge in which abrasion of the electrophotographic photosensitive member including a photoconductive layer provided on a rigid base can be reduced.

DESCRIPTION OF THE EMBODIMENTS

The present invention will be described referring to the accompanying drawings. The dimension, material, shape, relative layout thereof and the like of components that are described in an exemplary embodiment of the present invention, unless otherwise specifically stated, are not intended to limit the scope of this present invention.

Embodiment 1

(1) Overall Construction of Electrophotographic Image Forming Apparatus Example

Figure 1:
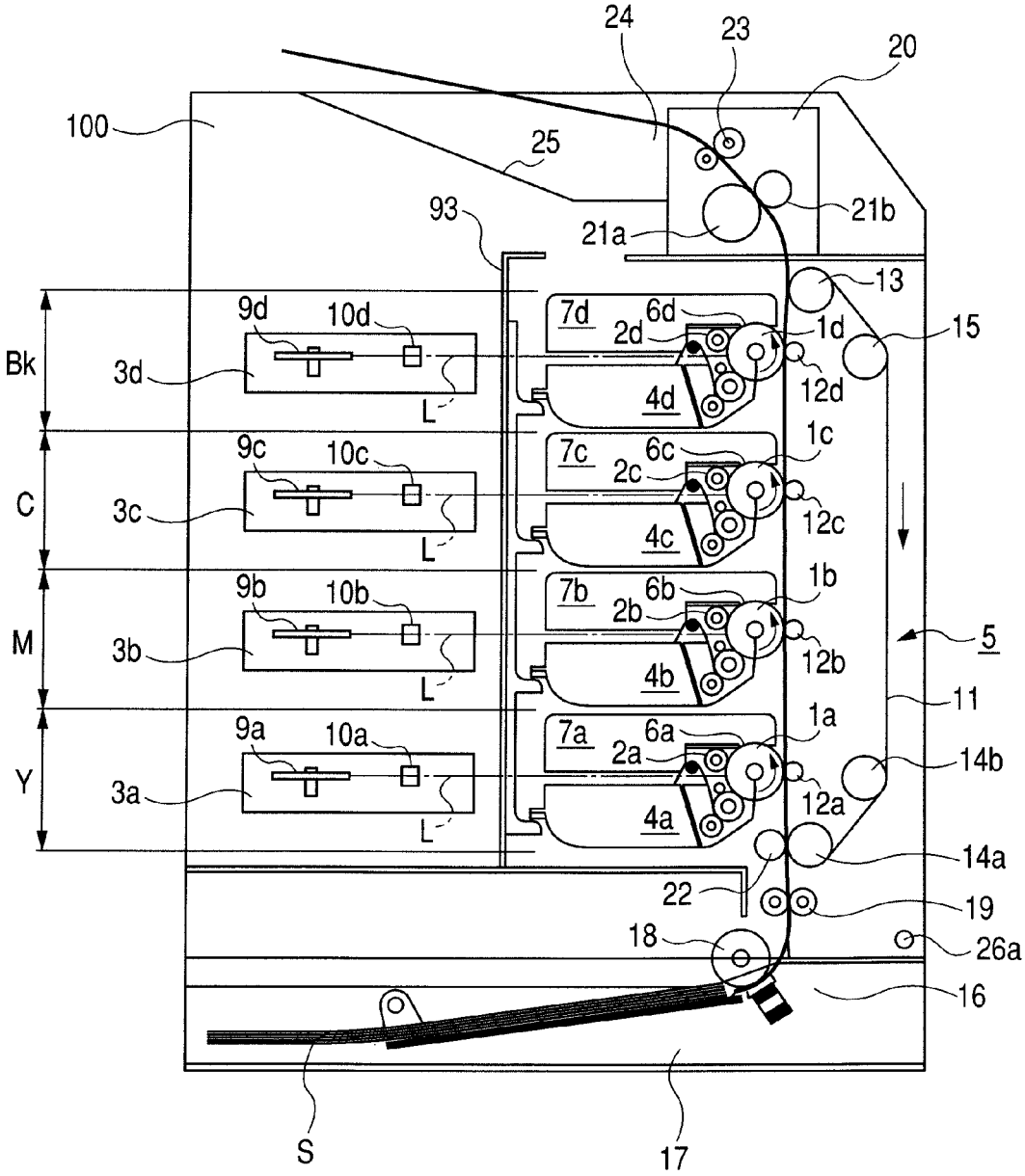
FIG. 1 is a schematic diagram of an overall construction of one example of an electrophotographic image forming apparatus.

FIG. 1 is a schematic diagram of the overall construction of one example of an electrophotographic image forming apparatus according to the present invention. This image forming apparatus is a full-color laser beam printer of a tandem type employing a transfer-type electrophotographic process.

In FIG. 1, Y-M-C-Bk are four numbers of a first to a fourth image-forming stations acting to form toner images of yellow, magenta, cyan and black corresponding to color separation component colors of a full-color image, respectively, and disposed in parallel in the order from bottom to top in an apparatus main body 100.

Each of the image-forming stations Y-M-C-Bk includes an electrophotographic process device such as a drum-shaped electrophotographic photosensitive member (hereinafter, it is referred to as a photosensitive drum) 1 (1*a*, 1*b*, 1*c*, and 1*d*) serving as an image bearing member, a charging device 2 (2*a*, 2*b*, 2*c*, and 2*d*), and a laser scanner unit 3 (3*a*, 3*b*, 3*c*, and 3*d*) serving as an exposure device. In addition, each of the image-forming stations Y-M-C-Bk includes an electrophotographic process device such as a developing device 4 (4*a*, 4*b*, 4*c*, and 4*d*) and a cleaning device 6 (6*a*, 6*b*, 6*c*, and 6*d*).

A scanner unit 3 (3*a* to 3*d*) applies a laser beam L onto the uniformly charged surface of the photosensitive drum 1 (1*a* to 1*d*) based on image information, and forms an electrostatic latent image on the photosensitive drum. This scanner unit 3 (3*a* to 3*d*) is disposed in the horizontal direction of the photosensitive drum 1 (1*a* to 1*d*), and includes a laser diode (not illustrated), a scanner motor (not illustrated), a polygon mirror 9 (9*a*, 9*b*, 9*c*, and 9*d*), an imaging lens 10 (10*a*, 10*b*, 10*c*, and 10*d*) and the like.

An electrostatic transfer unit 5 causes a toner image having been formed on the photosensitive drum 1 (1*a* to 1*d*) to transfer onto a recording medium (a material to be transferred with). In this electrostatic transfer unit 5, an endless transfer belt 11 that makes a cyclic movement so as to be opposed to the photosensitive drum 1 (1*a* to 1*d*) as well as to be contacted therewith is vertically located with passed over four rollers of a drive roller 13, two driven rollers 14*a* and 14*b*, and a tension roller 15. Transfer rollers 12 (12*a*, 12*b*, 12*c*, and 12*d*) are provided in parallel in contact with an inner circumferential surface of the transfer belt 11 so that the transfer belt 11 is sandwiched between these transfer rollers 12 and their respective photosensitive drums 1 (1*a* to 1*d*).

A recording medium feeding portion 16 is disposed at the lower portion of the apparatus main body 100 that forms a housing of the image forming apparatus. The recording medium feeding portion 16 feeds and conveys a recording medium S to the transfer belt 11 of the electrostatic transfer unit 5. This feeding portion 16 includes a sheet feeding cassette 17 in which a plurality of recording mediums S is contained, a feed roller 18, a registration roller 19, and an electrostatic attracting roller 22.

A fixing portion 20 is disposed at the upper portion of the apparatus main body 100. The fixing portion 20 fixes plural colors of a toner image having been transferred on the recording medium S. The fixing portion 20 includes a heating roller 21*a* to rotate, a pressure roller 21*b* to be contacted with the heating roller 21*a* to apply a pressure onto the recording medium S, a pair of discharge rollers 23, a discharge portion 24. A discharge tray 25 is provided on the upper portion of the apparatus main body 100.

The image-forming stations Y-M-C-Bk are driven in sequence in a predetermined control timing of an image forming sequence, and the photosensitive drums 1 (1*a* to 1*d*) are driven to rotate in the direction indicated by arrows. Furthermore, the transfer belt 11 is driven to rotate at a circumferential speed corresponding to the circumferential speed of rotation of the photosensitive drum 1 (1*a* to 1*d*) in the direction indicated by an arrow.

The outer circumferential surface (surface) of the photosensitive drum 1 (1*a* to 1*d*) is primarily charged evenly at a predetermined polarity (negative polarity in this embodiment) and at a predetermined potential by the charging device 2 (2*a* to 2*d*) in a rotation process thereof. An image exposure with a laser light L having been modulated based on image information to be output from the scanner unit 3 (3*a* to 3*d*) is conducted with respect to this charged surface, and thus an electrostatic latent image of the image information is formed on the surface of the photosensitive drum 1 (1*a* to 1*d*). That is, an image light in response to an image signal is output by the laser diode (not illustrated) of the scanner unit 3 (3*a* to 3*d*), and this image light is applied to the polygon mirror 9 (9*a* to 9*d*) in rotation at a high speed by the scanner motor (not illustrated). With the image light having been reflected by the polygon mirror 9 (9*a* to 9*d*), the photosensitive drum 1 (1*a* to 1*d*) having been charged is selectively exposed via the imaging lens 10 (10*a* to 10*d*). Whereby, an electrostatic latent image is formed on the surface of the photosensitive drum 1.

This electrostatic latent image is developed as a toner image using a toner (developer) by the developing device 4 (4*a* to 4*d*) (reversal development using a negative-polarity toner in this embodiment). With the arrangement, a toner image of each color of yellow, magenta, cyan and black, being a color separation component color image of a full-color image is formed by the electrophotographic process on the surface of the photosensitive drum 1 (1*a* to 1*d*) of each of the image-forming stations Y to Bk in a predetermined sequence control timing.

Whereas, in a predetermined control timing, the feed roller 18 of the feeding portion 16 is driven to rotate. Whereby, the recording medium S in the cassette 17 is separated and fed one by one. The leading edge of this recording medium S is abutted and received at a nip portion between a pair of the registration rollers 19 that are in the rotation-stopped state at this time point, and stopped for a short time. With synchronizing the rotation of the transfer belt 11 with the toner image to be formed on the photosensitive drum 1 (1*a* to 1*d*), a pair of the registration rollers 19 are driven to rotate. Whereby, the recording medium S is fed to between the electrostatic attracting roller 22 and the transfer belt 11. The recording medium S is sandwiched between the electrostatic attracting roller 22 and the transfer belt 11 to be in contact with the outer circumference (circumferential surface) of the transfer belt 11. By the application of a voltage to between the transfer belt 11 and the electrostatic attracting roller 22, an electric charge is induced at the recording medium S as a dielectric material and a dielectric layer of the transfer belt 11. Then, the recording medium S is attracted in an electrostatic manner to the surface of the electrostatic transfer belt 11. Whereby, the recording medium S is stably sucked to the transfer belt 11, and conveyed from the most upstream transfer portion to the most downstream transfer portion by the movement of the transfer belt 11 in the moving direction of the transfer belt 11.

The recording medium S, while being conveyed in such a way, by the application of en electric field to be formed between the photosensitive drum 1 (1*a* to 1*d*) and the transfer roller 12 (12*a* to 12*d*), is sequentially superimposed and transferred with the toner image of the photosensitive drum 1 (1*a* to 1*d*) In this embodiment, an electric charge of a positive polarity is applied from the transfer roller 12 (12*a* to 12*d*) to the recording medium S via the transfer belt 11. Due to the presence of the electric field generated by this electric charge, the toner image of a negative polarity on the photosensitive drum 1 (1*a* to 1*d*) is transferred on the recording medium S in contact with the photosensitive drum 1.

That is, the recording medium S is attracted in an electrostatic manner to the surface of the transfer belt 11, and conveyed from bottom up by the rotation of the transfer belt 11. Then, in the conveyance process thereof, at each transfer portion of the image-forming stations Y-M-C-Bk, each toner image of yellow, magenta, cyan and black formed on the surface of the associated photosensitive drum 1 (1*a* to 1*d*) is superimposed and transferred on the recording medium S. With the arrangement, on the surface of the recording medium S, a full-color toner image not having been fixed is synthesized and formed.

The recording medium S having been superimposed and transferred with four colors of toner images is self-stripped from the transfer belt 11 in the proximity of the drive roller 13 and conveyed to the fixing portion 20. Further, the recording medium S is sandwiched and conveyed by a nip portion (fixing nip portion) to be formed between the heating roller 21*a* in rotation and the pressure roller 21*b* contacted with the heating roller 21*a*. Whereby, the recording medium S is provided with a heat and a pressure by a pair of the rollers 21*a* and 21*b*. With the arrangement, the toner images of the plural colors are heated and fixed onto the surface of the recording medium S. The recording medium S is subjected to the above-mentioned toner image fixing at the fixing portion 20, and thereafter discharged to the discharge tray 25 outside the apparatus main body 100 from the discharge portion 24 by a pair of the discharge rollers 23.

At the image-forming stations Y-M-C-Bk, on the surface of the photosensitive drum 1 (1*a* to 1*d*) after transferring the toner image to the recording medium S, the remaining deposits such as the remaining toner not having been transferred are removed by the cleaning member 6 (6*a* to 6*d*), and the photosensitive drum 1 is repeatedly provided for image formation.

(2) Process Cartridge

The process cartridges 7 (7*a* to 7*d*) are detachably mounted to the image-forming stations Y-M-C-Bk, respectively. Each cartridge 7 includes a photosensitive drum 1 (1*a* to 1*d*), a charging device 2 (2*a* to 2*d*), a developing device 4 (4*a* to 4*d*), and a cleaning device 6 (6*a* to 6*d*). Furthermore, the cartridge 7 is detachably mountable to the apparatus main body 100.

The mounting/detaching operation of the cartridge 7 (7*a* to 7*d*) with respect to the apparatus main body 100 is made in the state in which a front opening/closing door 26 of the apparatus main body 100 is opened, and a cartridge insertion opening 27 (FIG. 5) in the apparatus main body 100 is largely opened.

Figure 5:
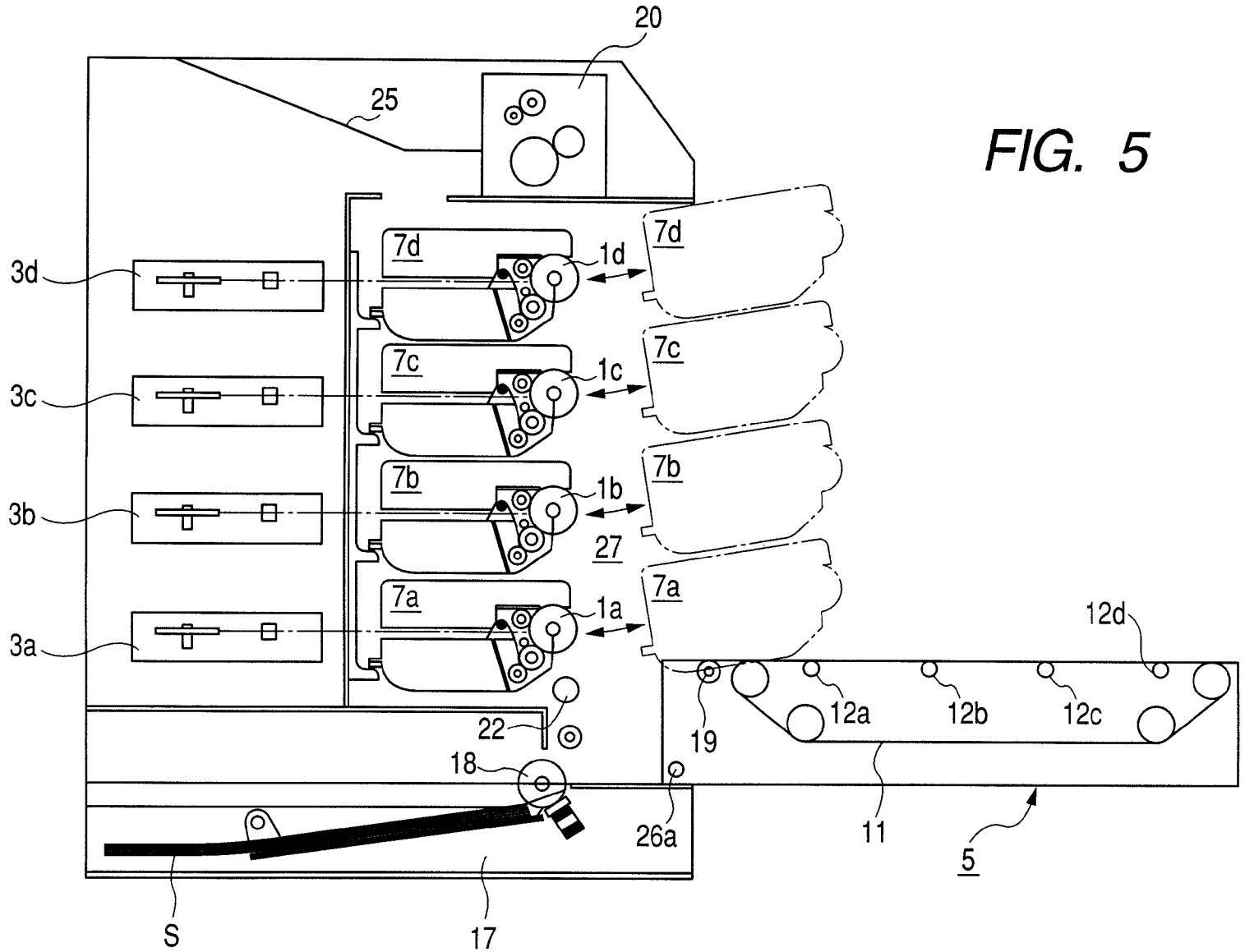
FIG. 5 is an explanatory view illustrating the state in which a front door of an apparatus main body is opened.

That is, the front cover portion of the apparatus main body 100 is formed to be a door 26 that can be opened and closed with respect to the apparatus main body 100, and that includes the electrostatic transfer unit 5 on the inside thereof. Furthermore, this door 26 can be opened to the front side of the apparatus main body 100 about a hinge shaft 26*a* at the lower portion (FIG. 1) by being opened to the front. With this door 26, the insertion opening 27 can be brought in an open state (FIG. 5).

In the descriptions hereinafter, a transversal direction of a cartridge and a member forming this cartridge is the direction of mounting and dismounting the cartridge with respect to the apparatus main body. Moreover, a longitudinal direction is the direction intersecting the direction of mounting and dismounting the cartridge with respect to the apparatus main body. As to the cartridge, the back face is the surface on the opposite side of the cartridge viewed from the front side of the apparatus main body, and both sides are the left and rights side of the cartridge viewed from the front side of the apparatus main body. Furthermore, the top face of the cartridge is the surface to be positioned above in the state in which the cartridge is mounted in the apparatus main body, and the underside is the surface to be positioned below.

Figure 2:
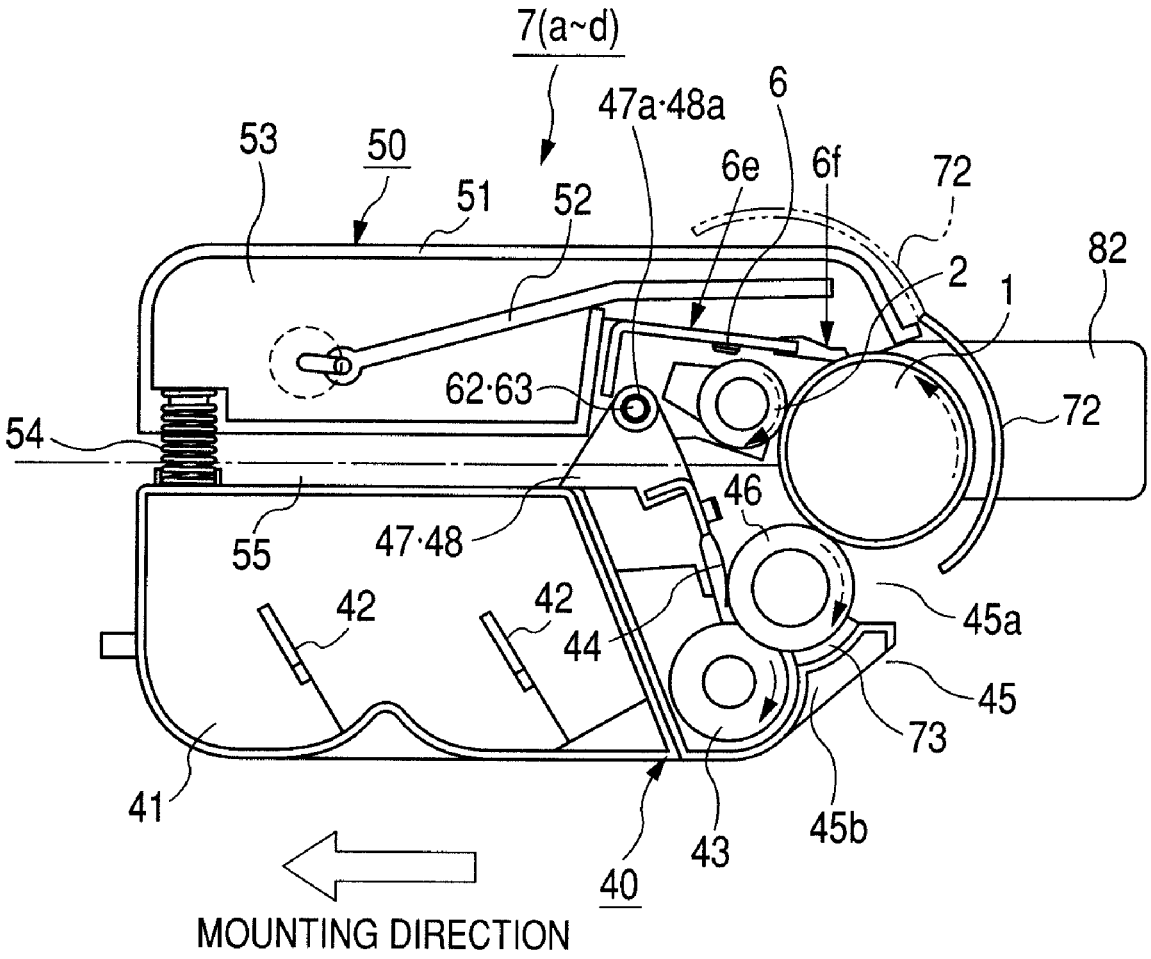
FIG. 2 is a schematic model diagram of one example of a process cartridge.
Figure 3:
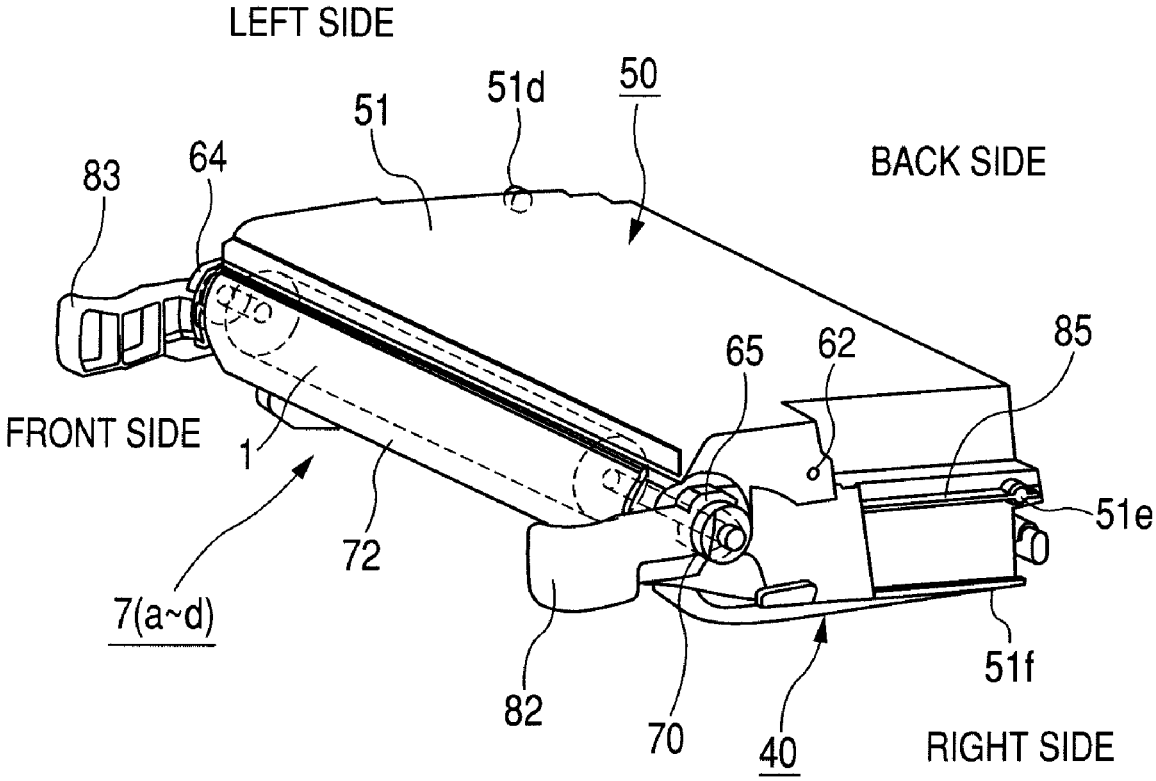
FIG. 3 is a schematic perspective view of the process cartridge.
Figure 4:
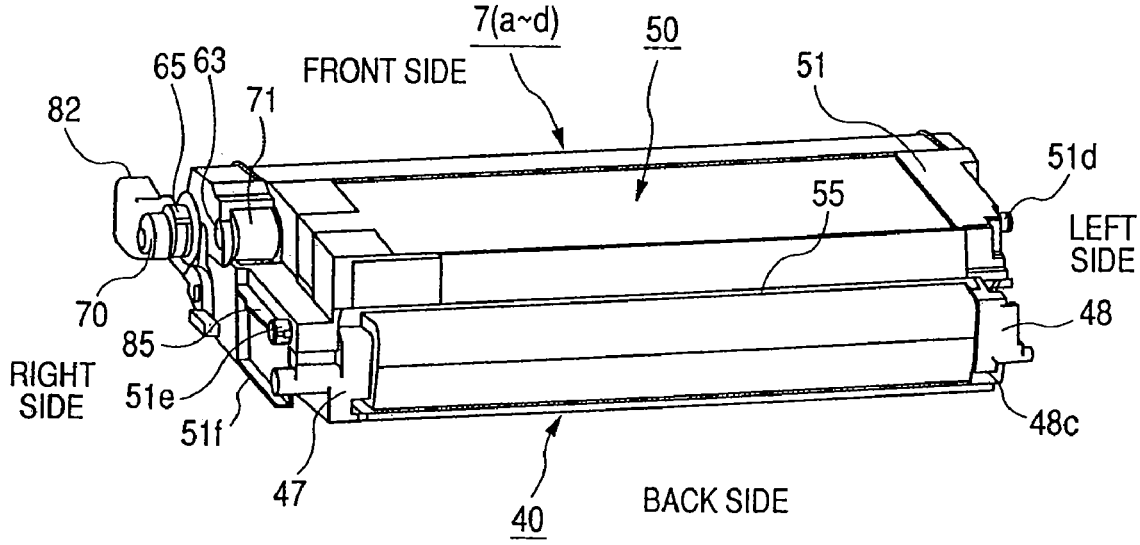
FIG. 4 is a schematic perspective view of the process cartridge.

FIG. 2 is a schematic model diagram of an example of a process cartridge according to the present invention. FIGS. 3 and 4 are respective schematic perspective views of the process cartridge.

In the cartridge 7 (7*a* to 7*d*) at the image-forming stations Y-M-C-Bk, a developer that is contained in a toner container of the developing device 4 (4*a* to 4*d*) is a toner of a yellow color in the cartridge 7*a* of the first image-forming station Y. In the cartridge 7*b* at the second image-forming station M, it is a toner of a magenta color. In the cartridge 7*c* at the third image-forming station, it is a toner of a cyan color. In the cartridge 7d at the fourth image-forming station Bk, it is a toner of a black color. Except for these points, the cartridges 7 (7*a* to 7*d*) are of the same construction.

As illustrated in FIG. 2, the cartridge 7 includes a cleaning unit 50 as a first frame that is provided with the photosensitive drum 1, the charging device 2 and the cleaning device 6, and a developing unit 40, as a second frame that is provided with the developing device 4.

In the cleaning unit 50, the photosensitive drum 1 is held so as to be rotatable, and the charging device 2 and the cleaning device 6 are arranged along the surface of this photosensitive drum 1. The remaining deposits such as the remaining toner not having been transferred that are removed from the surface of the photosensitive drum 1 by this cleaning device 6 is fed to a removed toner chamber 53 that is provided in the rear of the cleaning frame 51 by a toner feed mechanism 52. The charging device 2 employs a charging device of a contact charging type. A charging member functioning as the charging device 2 is a conductive roller that is formed to be roller-shaped. This conductive roller 2 is brought in contact with the surface of the photosensitive drum 1, and this roller 2 is applied with a charging bias voltage. Whereby, the surface of the photosensitive drum 1 is uniformly charged.

The developing unit 40 includes a toner container 41 and a developing frame 45. A toner (not illustrated) that is contained in the toner container 41, by a toner conveying mechanism 42 that is provided in this toner container 41, is fed to a toner feed roller 43 serving as a developer feed member that is rotatably held at the developing frame 45. In addition, the developing frame 45, in the longitudinal direction, includes an opening portion 45*a* on the surface side of photosensitive drum 1, and also includes a holding portion 45*b* holding the inside at each of both end portions of the developing roller 46 serving as a developer carrying member on both sides of this opening portion 45*a*. The surface of this holding portion 45*b* on the side of the developing roller 46 is formed to be circular-arc shaped, and a seal member 73 such as a felt material or a moltopren is provided on this circular-arc face. Further, both end portions of a shaft of the developing roller 46 are rotatably held at side plates. The developing roller 46 is held in the state in which the outer circumferential surface (surface) of this developing roller 46 is pressed to the seal member 73 (developing roller circumferential surface seal method). Each of the feed roller 43 and the developing roller 46 is disposed in parallel with the photosensitive drum 1. In addition, at the developing frame 45, there is provided a developing blade 44 serving as a developer coating member. Due to that this developing blade 44 is brought in contact with the outer circumference (circumferential surface) of the feed roller 43 and the surface of the developing roller 46, the surface of the developing roller 46 is uniformly coated with the toner that is frictionally charged. By the application of a developing bias to the developing roller 46, the toner is transferred from the surface of the developing roller 46 to the surface of the photosensitive drum 1, and a latent image on the surface of the photosensitive drum 1 is developed using this toner to be a toner image (developer image).

The photosensitive drum 1 is rotatably supported at the cleaning frame 51 by support members 64 and 65 at both end portions thereof (FIG. 3). The support members 64 and 65 are disposed between the cleaning frame 51 and grip portions 82 and 83 to be gripped on the occasion of mounting the cartridge 7 on the apparatus main body 100. At one end portion of the photosensitive drum 1, there is provided a coupling member 70 to which a driving force is transmitted from a drive motor (not illustrated) that is provided at the apparatus main body 100. The photosensitive drum 1 is rotated by this coupling member 70. In association with the rotation of this photosensitive drum 1, the above-mentioned toner feed mechanism 52 is driven via a gear train (not illustrated).

In addition, the cleaning frame 51 is provided with a shutter member 72 to protect the photosensitive drum 1. The shutter member 72, by an opening/closing mechanism (not illustrated), can be closed and opened between a closed position (FIGS. 2 and 3) in which an opening for externally exposing the photosensitive drum on the front side of the cartridge 7 is closed, and an opened position (indicated by a two-dot chain line in FIG. 2) of being shifted upward or downward from the opening for externally exposing the photosensitive drum. The shutter member 72 is held in the closed position in the state in which the cartridge 7 is taken out of the apparatus main body 100. Then, the shutter member 72 covers the externally exposed surface of the photosensitive drum 1 for protection. Furthermore, the shutter member 72, when the cartridge 7 is inserted in the apparatus main body 100, and the front door 26 of the apparatus main body 100 (FIG. 1) is closed, is moved to the opened position by a unit in association with the closing operation of this door 26. Then, the transfer belt 11 becomes in contact with the externally exposed surface of the photosensitive drum 1.

The developing unit 40 is in a hung structure in which the entire structure of this developing unit 40 is pivotally supported with respect to the cleaning unit 50. That is, in the developing unit 40, the toner container 41 is provided integrally with bearing members 47 and 48 (FIG. 4) at both longitudinal sides of the toner container 41. These bearing members 47 and 48 are provided with holes 47*a* and 48*a* each of which is a pivotal center. By the insertion of connection shafts 62 and 63 that are fitted to the cleaning frame 51 into these holes 47*a* and 48*a*, the developing unit 40 is pivotally attached to the cleaning frame 51. An exposure opening 55 is for introducing a laser light L to the surface of the photosensitive drum 1. This exposure opening 55 is formed between the developing unit 40 and the cleaning unit 50 on the occasion when the developing unit 40 is pivotally attached to the cleaning frame 51.

In addition, in the state of the cartridge 7 alone (in the state of not being mounted in the apparatus main body 100), about the connection shafts 62 and 63 having been inserted in the holes 47*a* and 48*a* to be the pivotal center of the bearing members 47 and 48, the developing roller 46 is brought into contact with the photosensitive drum 1 by the moment of rotation. To this end, there is disposed a compression spring 54, as an elastic member for pressing the developing unit 40, on the side of the bearing member 47 between the cleaning unit 50 and the developing unit 40, and there is disposed a tension spring (not illustrated) as the elastic member on the side of the bearing member 48 between the cleaning unit 50 and the developing unit 40.

A cartridge drive gear (helical gear) 71 (FIG. 4) is rotatably held by a connection shaft 63 at the bearing member 47 of the developing unit 40. In the state in which the cartridge 7 is mounted on the apparatus main body 100, the drive gear 71 is meshed with a main body drive gear (helical gear: not illustrated) of the apparatus main body 100 to receive a driving force from the main body drive gear. By the rotation of this drive gear 71, via a gear train (not illustrated), the developing roller 46, a toner conveying mechanism 42, and the toner feed roller 43 are driven.

(3) Mounting Method of a Process Cartridge

Figure 6:
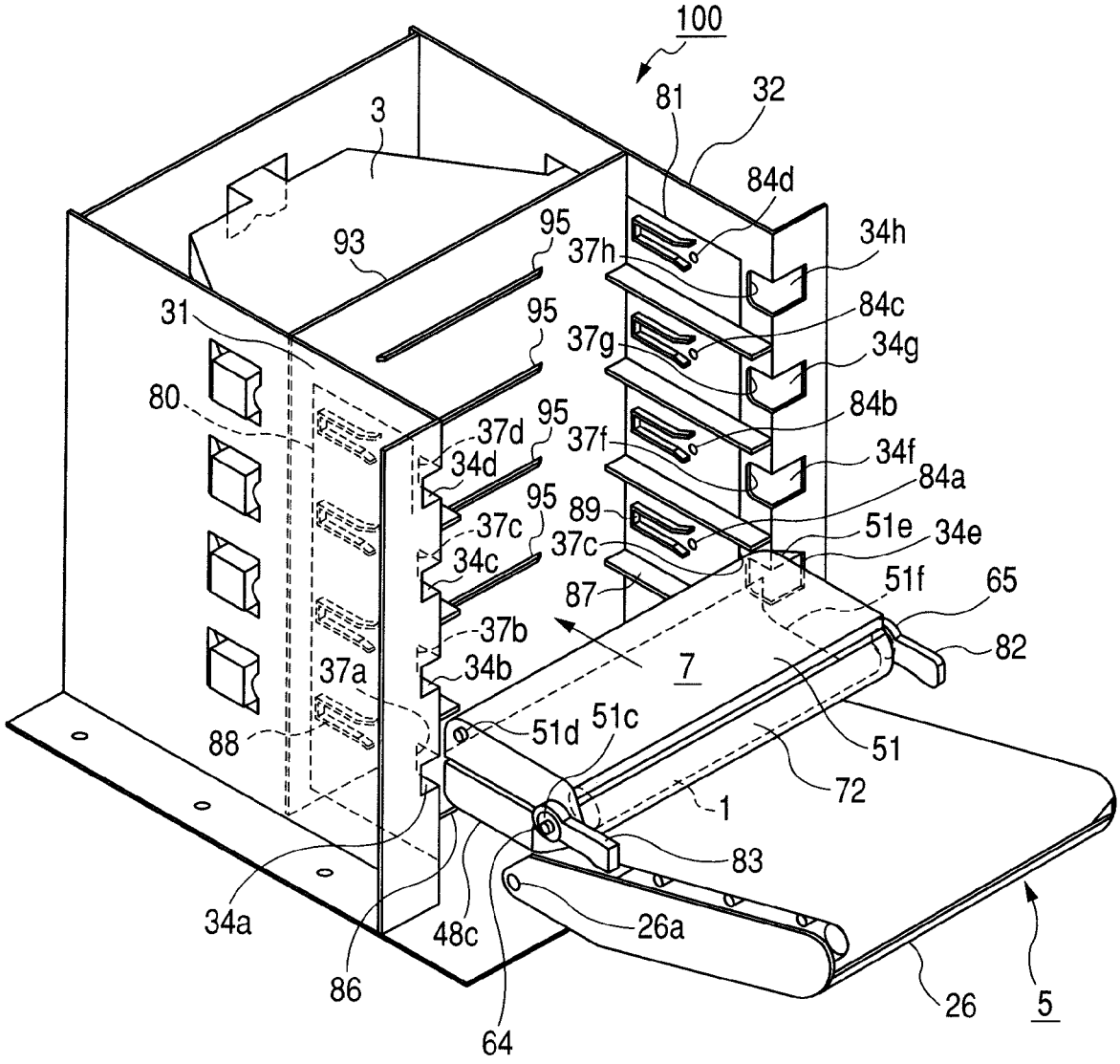
FIG. 6 is an explanatory view illustrating the state in which the cartridge is mounted on the apparatus main body.

Now, mounting of the cartridge 7 onto the apparatus main body 100 will be described with reference to FIGS. 5 and 6.

FIG. 5 is an explanatory view illustrating the state in which the front door 26 of the apparatus main body 100 is opened. FIG. 6 is an explanatory view illustrating the state in which the cartridge 7 is mounted on the apparatus main body 100.

Mounting/dismounting operations of the cartridge 7 (7*a* to 7*d*) with respect to the apparatus main body 100 are made in the state in which the front door 26 of the apparatus main body 100 is opened, and the cartridge insertion opening 27 in the apparatus main body 100 is largely opened. The closed state of the door 26 with respect to the apparatus main body 100 is locked by a latch mechanism (not illustrated). The lock by this latch mechanism thereof is released, and the door 26 is brought down and opened to the front side of the apparatus main body 100 about the hinge shaft 26*a* at the lower portion. Whereby, the insertion opening 27 in the apparatus main body 100 can be brought in the state of being largely opened.

In the insertion opening 27, main body guides 80 and 81 to introduce the cartridge 7 to an image forming position are attached to the inside of a left-side plate 31 and a right-side plate 32 of the apparatus main body 100. In the insertion opening 27, four cartridges 7 can be inserted individually in the vertical direction. From bottom, there are a yellow insertion opening, a magenta insertion opening, a cyan insertion opening, and a black insertion opening. There is provided between the left-side plate 31 and the right-side plate 32 an intermediate plate 93. There is provided in this intermediate plate 93 an irradiation window 95 causing a laser light L from the scanner 3 to pass.

Cartridge mounting mechanisms in the yellow insertion opening, the magenta insertion opening, the cyan insertion opening and the black insertion opening are of the same construction. Here, representatively, the case of inserting the cartridge 7 (7*a*) into the lowermost yellow insertion opening will be described.

First, an operator grips the grip portions 82 and 83 with left and right hands to hold the cartridge 7. Then, in the transversal direction of the cartridge 7, the cartridge 7 is inserted into the insertion opening 27 from the back side (FIGS. 5 and 6). On this occasion, an underside 48*c* of the bearing member 48 of the cartridge 7 and an underside 51*f* of the cleaning frame 51 are put on rough guides 86 and 87 that are provided at the main body guides 80 and 81 respectively. There are provided boss guides 88 and 89 at the main body guides 80 and 81. These boss guides 88 and 89 are engaged with bosses 51*d* and 51*e* that are provided on both sides of the cleaning frame 51 to regulate the rotation of the cartridge 7 in the apparatus main body 100. When the cartridge 7 is further inserted, the bosses 51*d* and 51*e* run on the boss guides 88 and 89 to be guided.

In addition, there are provided at the main body guide 81 a main body pressing unit 84 (84*a* to 84*d* from bottom) acting to press the cartridge 7 in the longitudinal direction. Further, in the process of inserting the cartridge 7 in the apparatus main body 100, the pressing unit 84 is contacted with the right-side face of the cartridge 7, that is, in this embodiment, a guide portion 85 (FIG. 3) that is provided on the right-side surface of the cleaning frame 51. Whereby, the cartridge 7 is pressed toward the left-side plate 31 in the longitudinal direction.

When the cartridge 7 is further inserted in the apparatus main body 100, the cartridge 7 receives a pressure provided by the pressing unit 84 with respect to the guide portion 85. Thus, by this pressure, the cartridge 7 is mounted while being biased to the opposite side, that is, the side of the left-side plate 31 opposite to the side of the right-side plate 32 on which the pressing unit 84 is disposed. Furthermore, at the end of the cleaning frame 51, there is provided an abutment surface 51*c* in order to be positioned in the apparatus main body 100. Furthermore, due to that the abutment surface 51*c* is contacted with the end surface of the main body guide 80 in the insertion process, the cartridge 7 is positioned in the longitudinal direction in the apparatus main body 100.

Moreover, the cartridge 7 is further inserted, and then the bearing member 64 of the cartridge 7 is moved along a guide groove 34 (34*a* to 34*d* from bottom) provided in the left-side plate 31 and the bearing member 65 is moved along a guide groove 34 (34*e* to 34*h* from bottom) provided in the right-side plate 32. Then, the bearing member 64 is abutted against an abutment surface 37 (37*a* to 37*d* from bottom) of the guide groove 34 in the left-side plate 31, and the bearing member 65 is abutted against an abutment surface 37 (37*e* to 37*h* from bottom) of the guide groove 34 in the right side plate 32 respectively. With the arrangement, the position of the cartridge 7 in the transversal direction with respect to the apparatus main body 100 is determined.

In the state in which the cartridge 7 is positioned in the apparatus main body 100 as mentioned above, a charging bias electrical contact (not illustrated) for applying a charging bias that is provided at the cartridge 7 and a charging bias main body electrical contact (not illustrated) that is provided at the apparatus main body are brought into contact with each other to be in the state of being electrically conducted. Whereby, the application of a charging bias onto the charging roller 2 can be made through these charging bias electrical contacts. In addition, a developing bias electrical contact (not illustrated) for applying a developing bias that is provided at the cartridge 7 and a developing bias main body electrical contact (not illustrated) that is provided at the apparatus main body are brought into contact with each other to be in the state of being electrically conducted. Whereby, the application of a developing bias to the developing roller 46 can be made through these developing bias electrical contacts. Moreover, the drive gear 71 that is provided at the cartridge 7 comes to be in the state of being meshed with the main body drive gear (not illustrated) of the apparatus main body.

As with the insertion of the cartridge 7 (7*a*) with respect to the above-described lowermost yellow insertion opening, the insertion of the cartridges 7 (7*b*, 7*c*, and 7*d*) with respect to the magenta insertion opening, the cyan insertion opening and the black insertion opening will be done.

Subsequently, the front opening/closing door 26 that is being opened is closed with respect to the apparatus main body 100. Further, this closed state is locked by the latch mechanism (not illustrated). By units associating with the operation of closing this door 26, conducted are 1) pressing and positioning in the transversal direction of each cartridge 7 in the apparatus main body 100, 2) movement to the opened position of the shutter member 72 of each cartridge 7, and 3) engagement of a power transmission coupling member of the apparatus main body 100 with respect to the coupling member 70 of each cartridge 7.

In the above-mentioned state in which each cartridge 7 is mounted with respect to the apparatus main body 100, the power transmission coupling member of the apparatus main body 100 is in the state of being engaged with the coupling member 70 of each cartridge 7. Whereby, the driving force from the drive motor (not illustrated) of the apparatus main body 100 is transmitted to the coupling member 70, and thus the photosensitive drum 1 of each cartridge 7 can be driven to rotate in the direction indicated by the arrow in FIG. 1. In association with the rotation of this photosensitive drum 1, via the not-illustrated gear train (not illustrated), the toner feed mechanism 52 of the removed toner chamber 53 can be driven.

In addition, the cartridge drive gear 71 of each cartridge 7 is in the state of being meshed with the not-illustrated main body drive gear (not illustrated) of the apparatus main body 100. Whereby, the drive gear 71 receives a driving force from the main body driving gear. Then, by the rotation of this drive gear 71, via the gear train (not illustrated), the developing roller 46, the toner conveying mechanism 42, and the toner feed roller 43 of each cartridge 7 are driven.

Taking each cartridge 7 out of the apparatus main body 100 is conducted in a reversing procedure to that in the above-mentioned mounting. That is, the lock provided by above-mentioned latch mechanism is released. Then, the door 26 is brought down to the front side of the apparatus main body 100 about the hinge shaft 26*a* at the lower portion so as to be opened. By units associating with the operation of opening this door 26, the engagement of the power transmission coupling member with respect to the coupling member 70 is released. Furthermore, the shutter member 72 is moved to the closed position. In this state, the grip portions 82 and 83 of the cartridge 7 are gripped by hands, and the cartridge 7 is pulled out in the direction opposite to that at the time of mounting. With the arrangement, each cartridge 7 can be taken out of the apparatus main body 100.

(4) Construction of a Photosensitive Drum, a Developing Roller and a Cleaning Device The construction of the photosensitive drum 1, the developing roller 46, and the cleaning device 6 will be described with reference to FIGS. 7 through 9.

Figure 7:
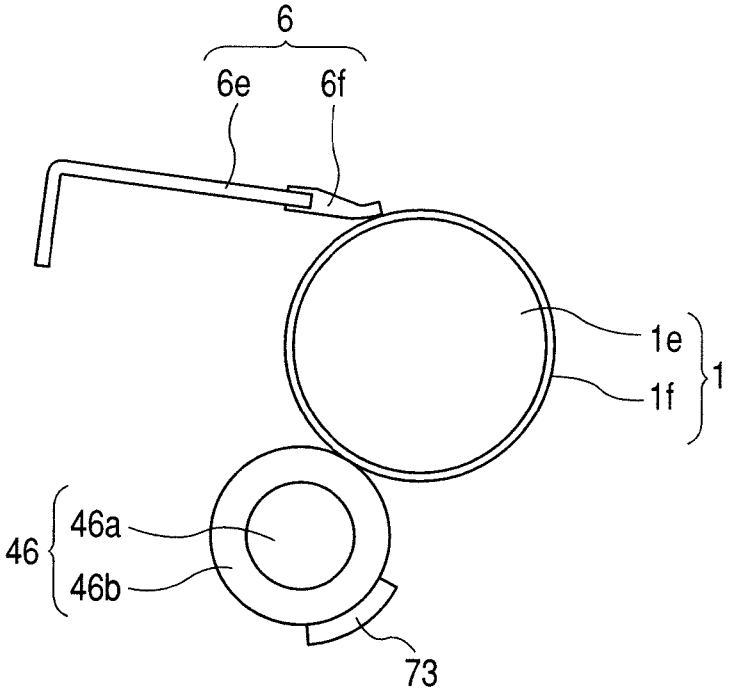
FIG. 7 is a longitudinally sectional view of a photosensitive drum, a developing roller, a seal member and a cleaning device.

FIG. 7 is a longitudinally sectional view of the photosensitive drum 1, the developing roller 46, the seal member 73 and the cleaning device 6. FIG. 8 is an expanded view indicating the longitudinal length of the photosensitive drum 1, the developing roller 46, the seal member 73 and the cleaning device 6. FIG. 9 is an explanatory view illustrating a method of measuring a contact pressure of a cleaning blade 6*f* of the cleaning device 6 with respect to the surface of the photosensitive drum 1.

1) Photosensitive Drum

The photosensitive drum 1 illustrated in this embodiment includes a rigid base 1*e*. For example, an aluminum base pipe that is 30 mm in diameter and 0.7 mm in wall-thickness is used as the base 1*e*. The outer circumferential surface of this base 1*e* is coated with an organic photoconductive layer as a photoconductive layer 1*f* (on the base 1*e*). The thickness of the photoconductive layer 1*f* is approximately 18 μm in the vicinity of the end portion of the photosensitive drum 1.

To suppress abrasion of the photoconductive layer 1*f*, the material of the photoconductive layer 1*f* employs a photoconductive layer containing a polyarylate resin hard to abrade. In this embodiment, a coat area Le of the photoconductive layer 1*f*, as illustrated in FIG. 8, is made equal to a longitudinal length Ldr of the developing roller 46. The coat area Le of the photoconductive layer 1*f* has only to be equal to or longer than the longitudinal length Ldr of the developing roller 46. In FIG. 8, Lr is the width in a main scanning direction of a latent image to be formed in the longitudinal direction (in the main scanning direction) of the photosensitive drum 1 with a laser light by the scanner unit 3, that is an area width of the latent image. In this embodiment, the main scanning directional width Lr of the latent image is set to be 208 mm, being a print guarantee area. Hereinafter, Lr is referred to as an image formation area. In addition, Le, being the longitudinal length of the photoconductive layer is set to be 256.5 mm.

2) Developing Roller

The developing roller 46 illustrated in this embodiment includes an elastic member 46*b* having conductivity so as to be 16 mm in diameter on the outer circumferential surface of a core bar 46*a* of SUS. The volume resistivity at the time of the application of −50V is about $10^5$ Ω to $10^6$ Ω from the viewpoint of developability, regular stripped pattern or the like. Furthermore, the hardness thereof is to be 50 degrees of Asker C hardness and 40 degrees of MD1 hardness. Both end portions of the core bar 46*a* are rotatably supported at the developing frame 45 such that the elastic member 46*b* makes inroad by 40 μm into the surface of the photosensitive drum 1. One end of the core bar 46*a* is connected to above-mentioned drive gear 71 via a gear (not illustrated). Further, the developing roller 46 is rotated at a circumferential speed of 281 mm/sec at the time of development to develop an electrostatic latent image on the photosensitive drum 1 with a toner. In addition, from the end portion of the core bar 46a, a developing bias of 300 V is applied at the time of development. Moreover, to prevent a toner leakage from both longitudinal end portions of the developing frame 45, above-mentioned seal member 73 is brought in contact with the circumferential surface at the end portions of the elastic layer 46*b*. Therefore, in this embodiment, as illustrated in FIG. 8, of the longitudinal length Ldr of the developing roller 46, the area between the inside ends of the seal members 73 which area is coated with a toner by the developing blade 44 is to be a toner coat area (carrying area where the developer is carried) Lt. Furthermore, the area from the inside end of the seal member 73 to the outside edge is to be a non toner coat area that is not coated with the toner (non-carrying area where no developer is carried) Lnt. Thus, the non toner coat area is the area where there is no interposed substance such as toner.

3) Cleaning Device

The cleaning device 6 illustrated in this embodiment includes a SUS metal plate 6*e* and a cleaning blade 6*f* serving as a cleaning member that is provided by a rubber chip having elasticity being attached by pressure at a tip end of this metal plate 6*e*. The tip end of this blade 6*f* is in contact with the surface of the photosensitive drum 1 at a desired angle and by a desired inroad amount. With this blade 6*f*, the remaining deposits such as the remaining toner not having been transferred are removed from the surface of the photosensitive drum 1 to clean the surface of the photosensitive drum 1. The tip end of this blade 6*f* is coated with a lubricant for maintaining a good cleaning performance.

Here, in the cleaning device 6, from Table 1, to ensure a good cleaning performance, the contact pressure (abutment pressure) of the blade 6*f* with respect to the surface of the photosensitive drum 1 is desirably set to be 65 g/cm to 120 g/cm.

TABLE 1

Relationship between an abutment line pressure of the cleaning blade with respect to the drum and a cleaning performance

| | cleaning blade abutment pressure g/cm | | | |
|---|---|---|---|---|
| | 55 | 65 | 120 | 130 |
| low-temperature cleaning performance | x | ○ | ○ | x |

○: good
x: bad

Figure 9:
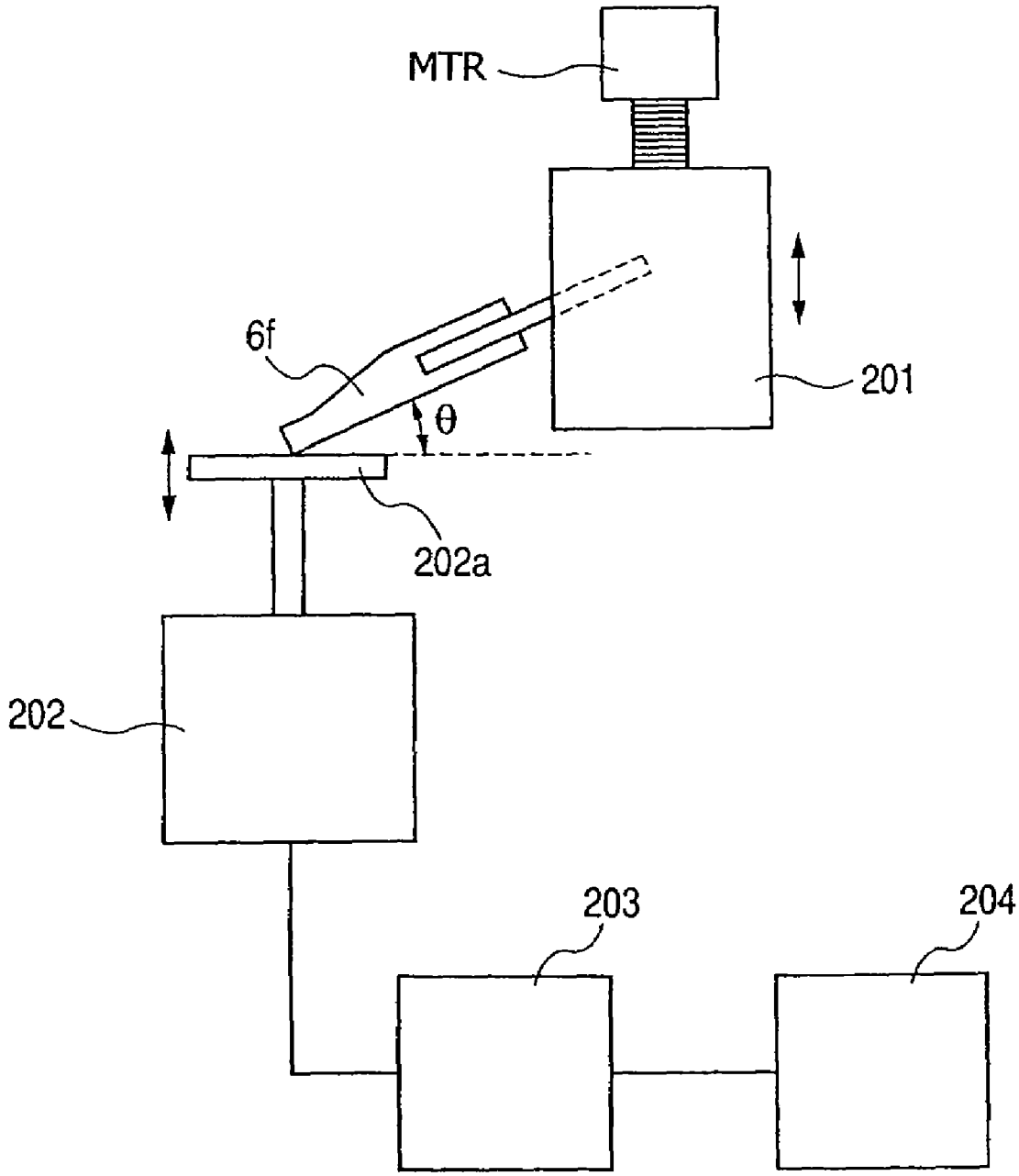
FIG. 9 is an explanatory view illustrating a measurement method of a contact pressure of a cleaning blade with respect to a photosensitive drum surface.

In this embodiment, the contact pressure of the blade 6*f* with respect to the surface of the photosensitive drum 1 is measured as illustrated in FIG. 9. The blade 6*f* is abraded to be 1 cm in width in the longitudinal direction, and this blade 6*f* is attached to a blade platform 201 that can be moved in a direction indicated by an arrow by a motor MTR and set to be at a desired angle θ. Then, the motor MTR is driven and the blade platform 201 is lowered to cause the tip end portion of the blade 6*f* to be in contact with a receiving plate 202*a* of a load sensor 202. Subsequently, the blade platform 201 is lowered by an inroad amount δ to be obtained and the tip end portion of the blade 6*f* is lowered by the inroad amount δ to be pressed to the receiving plate 202*a*. At this time, a load output value (voltage) of the load sensor 202 is amplified by an amplifier 203, and this amplified value is read by a voltmeter 204. When a load is obtained from a load output value based on the load per a unit voltage of the load output having preliminarily been obtained, the contact pressure of the blade 6*f* that is the line pressure per the width of 1 cm of the blade 6*f* can be obtained.

Figure 8:
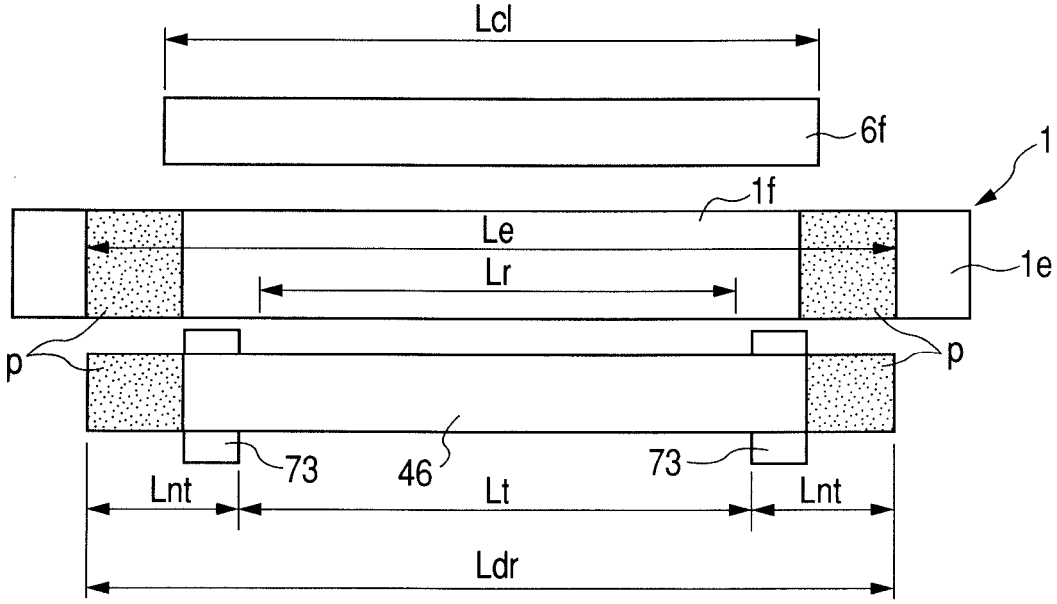
FIG. 8 is a developed view illustrating one example of the relationship of a longitudinal length among the photosensitive drum, the developing roller, the seal member and the cleaning device.

5) Longitudinal Length Relationship between a Developing Roller and a Cleaning Blade As illustrated in FIG. 8, the longitudinal length of the developing roller 46 in contact with the photosensitive drum 1 is to be Ldr, and the longitudinal length of the blade 6*f* in contact with the photosensitive drum 1 is to be Lcl. Furthermore, to reduce abrasion of the photosensitive drum 1, that is the abrasion of the photoconductive layer if (hereinafter, it is referred to as a drum abrasion), it is Ldr>Lcl. In this case, in the non toner coat area Lnt where there is no interposed substance, in a contact area between the surface of the developing roller 46 and the surface of the photosensitive drum 1 or a contact area between the surface of the photosensitive drum 1 and the blade 6*f*, an abrasion dust p of the photoconductive layer if is produced due to drum abrasion. The abrasion dust p having been produced longitudinally outside of the blade 6*f* is not cleaned by the blade 6*f*. This abrasion dust p, in the non toner coat are Lnt, remains on the surface of the developing roller 46 or the surface of the photosensitive drum 1, to suppress (reduce) abrasion of the photoconductive layer 1*f*.

(6) Drum Abrasion and Examination of Solutions

To reduce an defective image (leaked image) that is produced caused by drum abrasion in an image forming apparatus, made was an examination regarding I) drum abrasion in a toner coat area and a non toner coat are, and II) solutions.

1) Drum Abrasion in a Toner Coat Area and a Non Toner Coat Area

Figure 10:
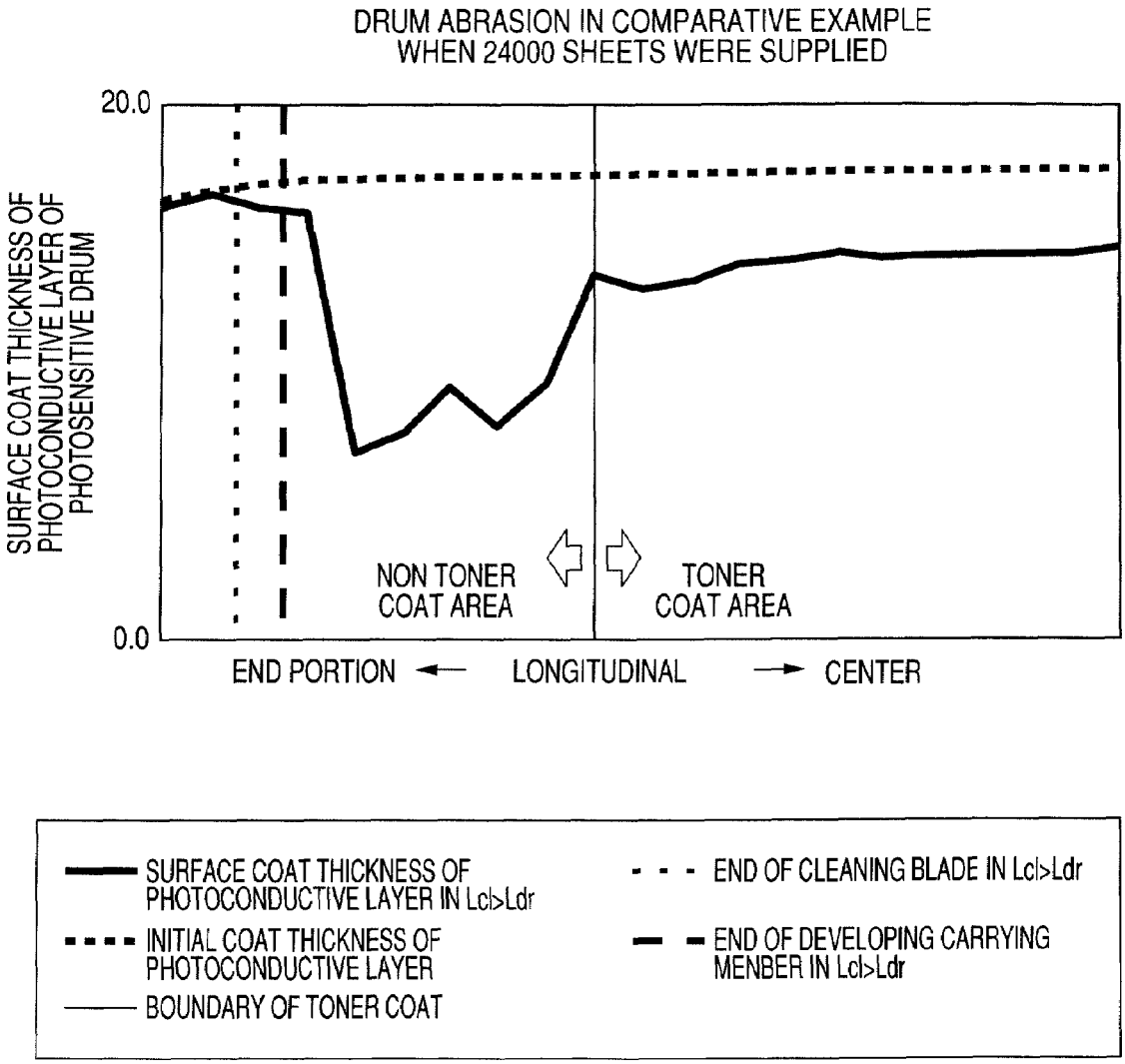
FIG. 10 is a chart illustrating a drum abrasion in an image forming apparatus in a comparative example.

As a comparative example, using a full-color laser beam printer (Color Laser Jet 4700 dn) in which the above-mentioned relationship between Lcl and Ldr is set to be Lcl>Ldr, an intermittent endurance test at intervals of two sheets for 24000 sheets was conducted at a coverage rate of 1% at environments of 23° C./50% Rh. The drum abrasion at this time is illustrated in FIG. 10. In this comparative example, Ldr is to be 238.6 mm and Lcl is to be 241 mm.

As illustrated in FIG. 10, the drum abrasion is characterized to be larger in the non toner coat area than in the toner coat area.

In the printer of the comparative example, a toner as an interposed substance is present in the toner coat area between the photosensitive drum surface and the developing roller surface. Therefore, there will be a smaller area where the photosensitive drum surface and the developing roller surface are directly contacted to be frictionally slid and ground each other, resulting in a less drum abrasion.

On the other hand, no toner as an interposed substance is present in the non toner coat area between the photosensitive drum surface and the developing roller surface. Therefore, there is present the area where the photosensitive drum surface and the developing roller surface are directly contacted to be frictionally slid and ground each other. On the photosensitive drum surface having been frictionally slid and ground, an abrasion dust of the photoconductive layer is produced. The abrasion dust serves to suppress the drum abrasion as an interposed substance between the photosensitive drum and the developing roller.

In the printer of the comparative example, however, since it is Lcl>Ldr, the abrasion dust of the photoconductive layer having been produced in the non toner coat area is to be cleaned by the cleaning blade. Then, in the state in which there is no interposed substance such as an abrasion dust or a toner between the photosensitive drum and the developing roller, the photosensitive drum repeats frictional sliding and grinding with the developing roller. Thus, the abrasion amount comes to be larger in the non toner coat area than in the toner coat area.

Furthermore, since the developing roller is held at the end portions, the abutment pressure thereof with respect to the photosensitive drum comes to be larger at end portions. Moreover, depending on a manufacturing method of the developing roller, there are some cases where the end portion of the developing roller has such a convex shape as to make abrasion of the photosensitive drum larger. Thus, as a result, as it gets closer to the end area of the developing roller, the abrasion amount is increased.

II) Solutions

In the case where the relationship between the above-mentioned Lcl and Ldr is Ldr>Lcl, an interposed substance such as an abrasion dust of the photoconductive layer 1*f* having been produced in the non toner coat area is not cleaned by the cleaning blade. This interposed substance, in the non toner coat area, will remain on the surface of the photosensitive drum 1 or on the surface of the developing roller 46. This abrasion dust of the photoconductive layer is made to act as an interposed substance, thereby enabling to largely suppress the drum abrasion.

Figure 11:
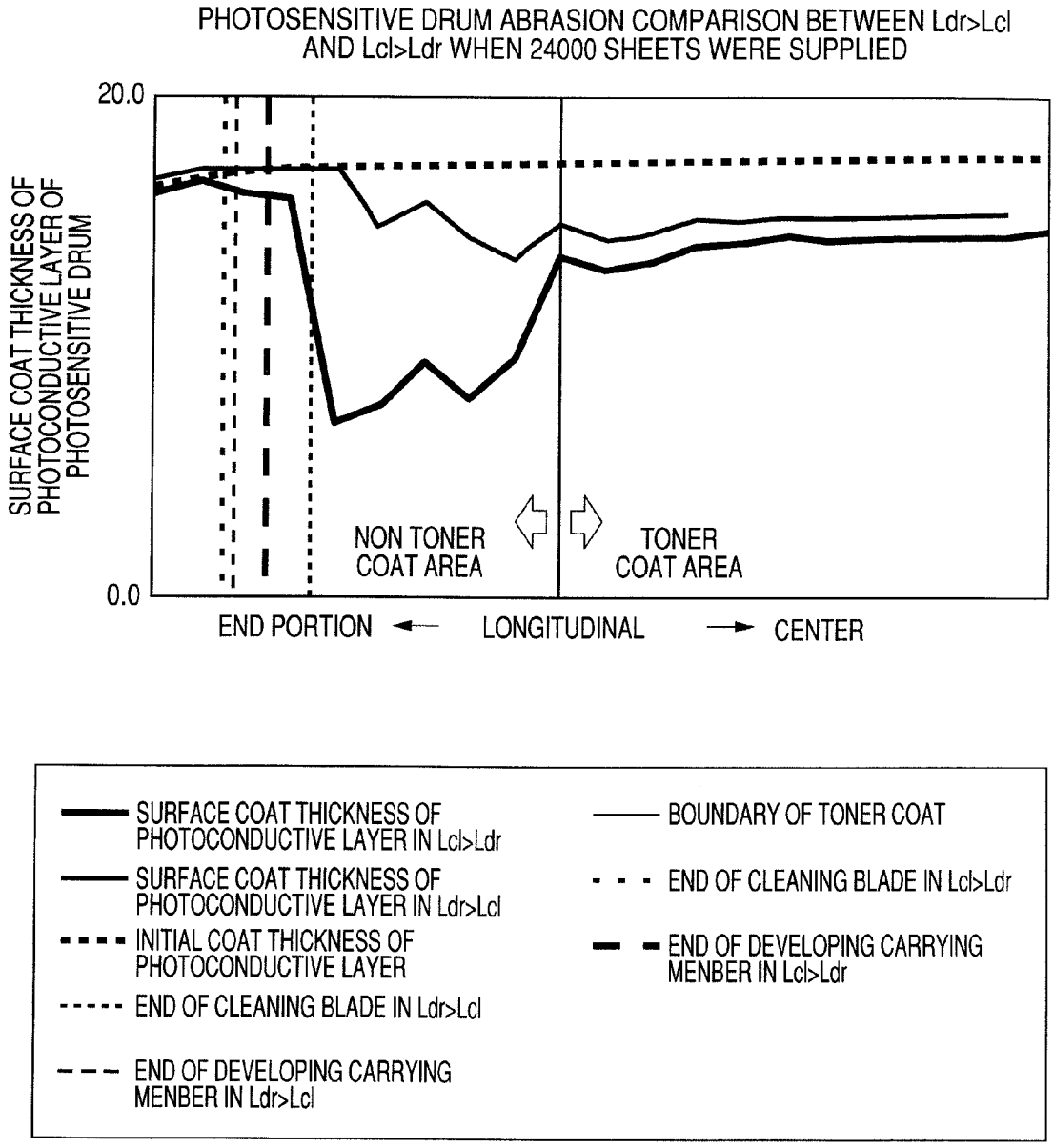
FIG. 11 is a chart illustrating the drum abrasion amount in the case of Lcl>Ldr and the drum abrasion amount in the case of Ldr>Lcl.

Actually, a test of comparing the drum abrasion amount in the case of Lcl>Ldr with the drum abrasion amount in the case of Ldr>Lcl was conducted. In this embodiment, Ldr is to be 240.6 mm and Lcl is to be 237 mm. Test conditions, using a full-color laser beam printer (Color Laser Jet 4700 dn), were to conduct an intermittent endurance test at intervals of two sheets for 24000 sheets at a coverage rate of 1% at environments of 23° C./50% Rh. FIG. 11 is a chart showing test results thereof.

As is apparent from FIG. 11, on condition of Ldr>Lcl, the drum abrasion in the non toner coat area Lnt was largely suppressed. After the test, the abrasion dust p of the photoconductive layer was detected from the surface of the developing roller 46 in the non toner coat area Lnt. Whereby, it was confirmed that in the case of Ldr>Lcl, the abrasion dust p is not cleaned by the blade 6*f*, and remains on the surface of the developing roller 46 or the surface of the photosensitive drum 1 in the non toner coat area Lnt as an interposed substance. At the portion where the non toner coat area and the area of the cleaning blade are longitudinally overlapped, since the abrasion dust is cleaned by the cleaning blade, there will be present no interposed substance. As described above, however, from the reasons of the abutment pressure or the end shape of the roller, the end portions of the developing roller are most likely to abrade the drum. Since abrasion at these end portions most likely to abrade is suppressed in the present invention, as compared with the comparative example, abrasion can be reduced in this embodiment of the present invention.

According to this embodiment, Ldr>Lcl as mentioned above, in the non toner coat area Lnt, drum abrasion of the photosensitive drum 1 can be reduced, and thus the production of a defective image due to the leakage can be suppressed.

Embodiment 2

Another exemplary embodiment of a cartridge will be described. In this embodiment, members and portions that are common with those of the first embodiment are designated with like reference numerals to omit repeated descriptions. It is the same as in a third exemplary embodiment.

In the cartridge 7 of the first embodiment, in the case where with respect to an image formation area Lr of the photosensitive drum 1, the longitudinal length Lcl of the blade 6*f* contacted with the photosensitive drum 1 is shorter (Lr>Lcl), the remaining toner not having been transferred that remains on the surface of the photosensitive drum 1 outside of Lcl cannot be cleaned.

Then, a carriage 7 according to this embodiment is constructed such that the remaining toner not having been transferred in the image formation area Lr that is not overlapped with the blade 6*f* in the longitudinal direction of the photosensitive drum 1 can be cleaned.

Figure 12:
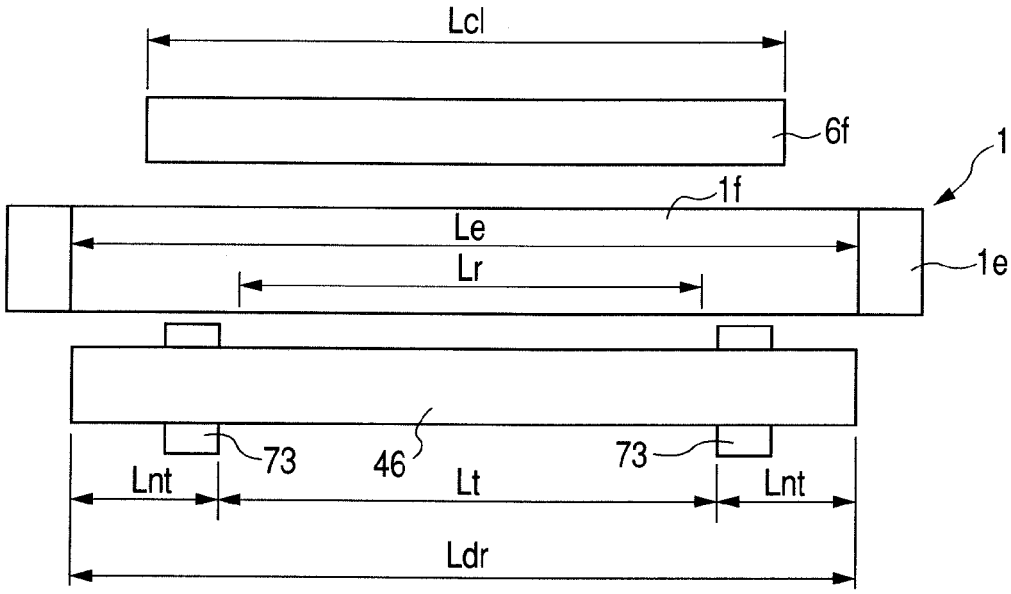
FIG. 12 is an expanded view illustrating another example of the relationship of the longitudinal length among the photosensitive drum, the developing roller, and the cleaning device.

FIG. 12 is an expanded view illustrating the longitudinal length of the photosensitive drum 1, the developing roller 46, and the cleaning device 6 of the cartridge 7 according to this embodiment. With reference to FIG. 12, the relationship among the longitudinal length Ldr of the developing roller 46 to be contacted with the photosensitive drum 1, the longitudinal length Lcl of the blade 6*f* to be contacted with the photosensitive drum 1, and the image formation area Lr of the photosensitive drum 1 will be described.

The cartridge 7 illustrated in this embodiment, from the viewpoint of preventing a defective image that is produced caused by the remaining toner not having been transferred, Lcl is set not less than Lr (Lcl>Lr). Whereby, the remaining toner not having been transferred can be cleaned by the blade 6*f*. As with the first embodiment, Lcl is 237 mm and Lr is 208 mm, to be Lcl>Lr. Although originally Lcl is set to be longer than Lr, Lcl may be set to be equal to Lr. This embodiment, in consideration of the case where the remaining toner not having been transferred is scattered in the longitudinal direction of the photosensitive drum 1, is constructed as described above.

Whereas, from the viewpoint of drum abrasion, as with the first embodiment, Ldr (240.6 mm)>Lcl (237 mm). Whereby, the same effect as that of the first embodiment can be obtained.

That is, Ldr, Lcl and Lr are set so as to be in the relationship of Ldr>Lcl≧Lr.

Incidentally, to set Ldr>Lcl, as compared with a conventional case, the cleaning blade is not made shorter, but the length of the developing roller 46 is made longer. The reason thereof is that the cleaning blade needs to be long to some extent for cleaning a toner, and hard to be shortened. In this embodiment, the relationship between the developing roller Ldr and the length Lr of a latent image is Ldr−Lr=31.2 (mm), and thus the developing roller is made longer than the conventional one. Thus, due to that the distance between the end of the area where the latent image is formed and the end of the developing roller is made larger, it is possible for abrasion of the photosensitive drum 1 that is likely to be produced at the developing roller end portion not to affect the formation of the latent image. It is desired to be Ldr−Lr≧24 (mm).

According to this embodiment, Ldr>Lcl, so that in the non toner coat area Lnt, drum abrasion of the photosensitive drum 1 can be reduced, and thus the production of a leaked image can be suppressed. In addition, Lcl≧Lr, so that the remaining toner not having been transferred can be cleaned by the blade 6*f*.

Embodiment 3

Another Example of a Cartridge will be Described

In the cartridge 7 according to the first embodiment, assumed are that the image formation area Lr of the photosensitive drum 1>the longitudinal length Lcl of the blade 6*f* to be contacted with the photosensitive drum 1, as well as that the longitudinal length Lcl of the blade 6*f* to be contacted with the photosensitive drum 1>the image formation area Lr of the photosensitive drum 1. In this case, when the toner coat area Lt is extended outside of the image formation area Lr (Lt>Lr), the toner remaining in the difference area between Lt and Lr on the surface of the developing roller 46 is stuck onto the surface of the photosensitive drum 1 to be a fog toner. In this case, the fog toner cannot be cleaned by the blade 6*f*.

Then, the cartridge 7 illustrated in this embodiment is constructed such that the fog toner can be cleaned by the blade 6*f*.

Figure 13:
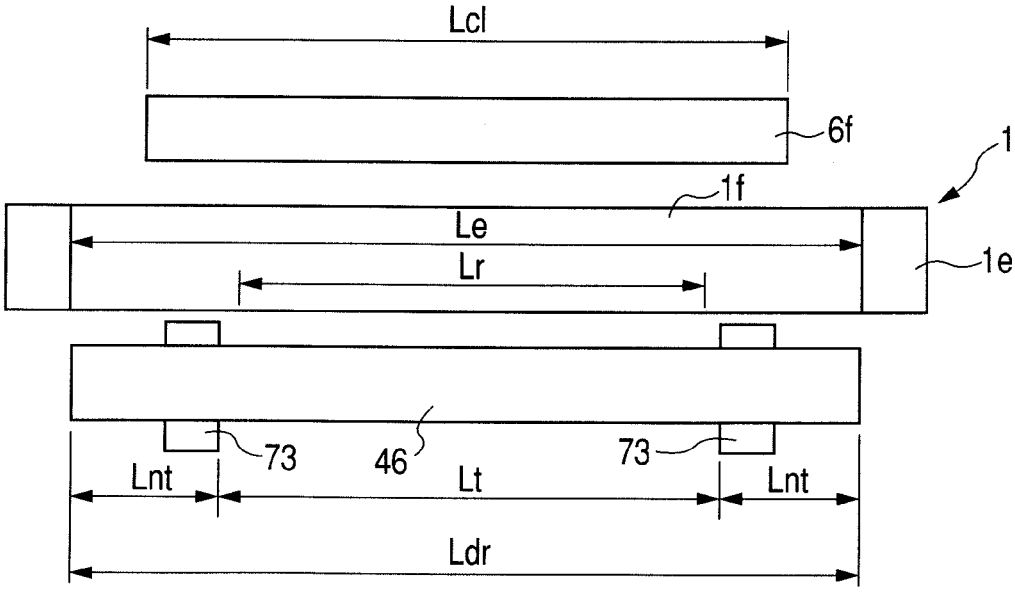
FIG. 13 is an expanded view illustrating another example of the relationship of the longitudinal length among the photosensitive drum, the developing roller, and the cleaning device.

FIG. 13 is an expanded view illustrating the longitudinal length of the photosensitive drum 1, the developing roller 46, and the cleaning device 6 of the cartridge 7 according to this embodiment. With reference to FIG. 13, the relationship among the longitudinal length Ldr of the developing roller 46 to be contacted with the photosensitive drum 1, the longitudinal length Lcl of the blade 6*f* to be contacted with the photosensitive drum 1, and the toner coat area Lt of the developing roller 46 will be described.

In the cartridge 7 illustrated in this embodiment, to clean the fog toner on the surface of the developing roller 46, Lcl is set to be not less than Lt. In this embodiment, Lcl is 237 mm and Lt is 222 mm, and Lcl≧Lt. Although originally Lcl is set to be longer than Lt, Lcl may be set to be equal to Lt. This embodiment, in consideration of the case where the toner having been coated on the surface of the developing roller 46 is scattered in the longitudinal direction of the developing roller 46, is constructed as described above.

Whereas, from the viewpoint of drum abrasion, as with the first embodiment, Ldr (240.6 mm)>Lcl. Whereby, the same effects as that in the first embodiment can be obtained.

That is, Ldr, Lcl and Lt are set so as to be in the relationship of Ldr>Lcl≧Lt.

According to this embodiment, Ldr>Lcl, so that in the non toner coat area Lnt, drum abrasion of the photosensitive drum 1 can be reduced, and thus the production of a leaked image can be suppressed. In addition, it is Lcl≧Lt, so that the fog toner can be cleaned by the blade 6*f*.

Others

In each embodiment, the developing roller 46 has only to be set on condition of enabling the abrasion of the photoconductive layer if with respect to the photosensitive drum 1 including the rigid base 1*e*. In this embodiment, to represent the state of being in contact with respect to the photosensitive drum 1 having a circumferential speed difference, the developing roller 46 including the elastic member 46*b* is brought into contact with the surface of the photosensitive drum 1 as a developer carrying member. As long as the developer carrying member is set to be on condition that the photoconductive layer if is worn, the shape, the material and the like are not limited.

Furthermore, an image forming apparatus may not employ the form of the process cartridge 7 (7*a* to 7*d*), but may be the apparatus in which the photosensitive drum 1 (1*a* to 1*d*), the charging device 2 (2*a* to 2*d*), the developing device 4 (4*a* to 4*d*) and the cleaning device 6 (6*a* to 6*d*) are directly provided in the apparatus main body 100.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-017743, filed Jan. 29, 2007, which is hereby incorporated by reference herein in its entirety.

What is claimed is:

1. An electrophotographic image forming apparatus forming an image on a recording medium, the electrophotographic image forming apparatus comprising:

an electrophotographic photosensitive drum including a photoconductive layer on a rigid base;

an exposure device forming a latent image on the electrophotographic photosensitive drum along a longitudinal direction of the electrophotographic photosensitive drum;

a developer carrying member that carries a developer along the longitudinal direction of the electrophotographic photosensitive drum as well as developing the latent image using the developer in contact with the electrophotographic photosensitive drum; and a cleaning blade that cleans the electrophotographic photosensitive drum in contact with the electrophotographic photosensitive drum along the longitudinal direction of the electrophotographic photosensitive drum, wherein when it is assumed that a longitudinal length of the photoconductive layer is Le, a longitudinal length of the developer carrying member to be contacted with the electrophotographic photosensitive drum is Ldr, and a longitudinal length of the cleaning blade to be contacted with the electrophotographic photosensitive drum is Lcl, the following expression is satisfied:

Le≧Ldr>Lcl, wherein in the longitudinal length Ldr of the developer carrying member, the developer carrying member includes a carrying area where a developer is carried and a non-carrying area where no developer is carried, and wherein when it is assumed that a longitudinal length of the carrying area of the developer carrying member is Lt, the following expression is satisfied:

Lcl≧Lt, and wherein a position of an end of the developer carrying member and a position of an end of the cleaning blade in the longitudinal direction on one end of the electrophotographic photosensitive drum are arranged in succession from an outside in the longitudinal direction.

2. An electrophotographic image forming apparatus according to claim 1, wherein when it is assumed that an area width of the latent image to be formed on the electrophotographic photosensitive drum by the exposure device is Lr, the following expressions are satisfied:

Ldr>Lcl≧Lr; and $Ldr-Lr>24$ (mm).

3. A process cartridge detachably mountable to an apparatus main body of an electrophotographic image forming apparatus, the process cartridge comprising:

an electrophotographic photosensitive drum including a photoconductive layer on a rigid base;

a developer carrying member that carries a developer as well as developing a latent image using the developer, the developer carrying member being brought into contact with the electrophotographic photosensitive drum; and a cleaning blade that cleans the developer on the electrophotographic photosensitive drum in contact with the electrophoto graphic photosensitive drum, wherein when it is assumed that a longitudinal length of the photoconductive layer is Le, a longitudinal length of the developer carrying member to be contacted with the electrophotographic photosensitive drum is Ldr, and a longitudinal length of the cleaning blade to be contacted with the electrophotographic photosensitive drum is Lcl, the following expression is satisfied:

Le≧Ldr>Lcl, wherein in the longitudinal length Ldr of the developer carrying member, the developer carrying member includes a carrying area where a developer is carried and a non-carrying area where no developer is carried, and wherein when it is assumed that a longitudinal length of the carrying area of the developer carrying member is Lt, the following expression is satisfied:

Lcl≧Lt, and wherein a position of an end of the developer carrying member and a position of an end of the cleaning blade in the longitudinal direction on one end of the electrophotographic photosensitive drum are arranged in succession from an outside in the longitudinal direction.

4. A process cartridge according to claim 3, wherein when it is assumed that an area width of the latent image to be formed on the electrophoto graphic photosensitive drum by an exposure device is Lr, the following expressions are satisfied:

Ldr>Lcl≧Lr; and $Ldr-Lr>24$ (mm).

* * * * *